United States Patent [19]

Wood

[11] 4,117,850

[45] Oct. 3, 1978

[54] SMOKING MIXTURES

[75] Inventor: William Malcolm Logan Wood, Manchester, England

[73] Assignee: Imperial Chemical Industries Limited, London, England

[21] Appl. No.: 682,788

[22] Filed: May 3, 1976

[30] Foreign Application Priority Data

May 27, 1975 [GB] United Kingdom ..... 23151/75

[51] Int. Cl.[2] ..... A24D 1/18

[52] U.S. Cl. ..... 131/2

[58] Field of Search ..... 131/2, 17 R, 17 AC, 131/140 C, 140 R

[56] References Cited

U.S. PATENT DOCUMENTS

| | | | |
|---|---|---|---|
| 3,529,602 | 9/1970 | Hind et al. | 131/2 |
| 3,718,153 | 2/1973 | Kobari et al. | 131/2 |
| 3,812,864 | 5/1974 | Cartwright | 131/2 |
| 3,861,400 | 1/1975 | Perkins et al. | 131/2 |
| 3,878,850 | 4/1975 | Gibson et al. | 131/2 |
| 3,931,824 | 1/1976 | Miano et al. | 131/2 |

*Primary Examiner*—Robert W. Michell
*Assistant Examiner*—V. Millin
*Attorney, Agent, or Firm*—Cushman, Darby & Cushman

[57] ABSTRACT

A smoking material comprising smoke-producing fuel, fortifying nicotine, calcium and/or magnesium carbonate as incombustible filler, at least one water-soluble salt selected to inhibit dissolution of the calcium and/or magnesium carbonate in water, and a phosphate buffer consisting of an acid salt of orthophosphoric acid or of a polyphosphoric acid to maintain the slurry pH at less than 6.

17 Claims, No Drawings

SMOKING MIXTURES

This invention relates to smoking materials fortified with nicotine.

Although the nicotine naturally present in tobacco remains stable during storage it is well known that when free nicotine or a nicotine salt is used to fortify smoking materials it is fully effective for a short time only and storage causes loss of nicotine by volatilisation and decomposition. Nicotine loss on storage of such fortified materials is especially great when the smoking material also contains calcium and/or magnesium carbonate as incombustible filler. When carbonate-filled materials contain tobacco, particularly a tobacco of high nicotine content e.g. Nicotiana Rustica, the carbonates may even have an adverse effect upon the stability of the nicotine in the tobacco itself.

According to the invention an improved smoking material comprises smoke-producing fuel, fortifying nicotine, calcium and/or magnesium carbonate as incombustible filler, at least one water-soluble salt selected to inhibit dissolution of the calcium and/or magnesium carbonate in water, and a phosphate buffer consisting of an acid salt of orthophosphoric acid or a polyphosphoric acid to maintain the slurry-pH of the material at less than 6.

The expression "slurry-pH" means the pH of the aqueous solution formed by slurrying the material with water to give a 15% solution/suspension. Slurrying can be carried out by mixing well, or by grinding in cases where particles need to be disrupted.

As smoke-producing fuels the smoking materials may contain tobacco or other smokeable vegetable matter for example dried lettuce leaves, or other tobacco substitute materials, for example carbohydrate (particularly cellulose) or modified carbohydrate e.g. cellulose ethers (particularly carboxymethyl cellulose and its salts) oxidised cellulose and especially thermally degraded carbohydrates (particularly thermally degraded cellulose) made as described in our UK Pat. No. 1,113,979 and our UK Application No. 40324/72 by subjecting carbohydrate to a catalysed thermal degradation at above 100° C. until the weight of the degraded material is less than 90% of the weight of the original carbohydrate. Desirably at least a portion of the smoke-producing fuel may be such that it also functions as a binder or film former, enabling the material to be fabricated into sheets (films) filaments, tapes or other forms from which tobacco-simulating material may be made. The proportion of smoke-producing fuel in the smoking material may be for example from 15 to 85% by weight.

Fortifying nicotine incorporated in the smoking materials may be originally in the form of the free base or a salt, particularly a salt with an organic acid e.g. the malate, citrate or lactate, or the alginate or pectinate as described in UK Pat. No. 1,391,604 or in the form of a tobacco extract. The fortifying nicotine may also be present in the form of a tobacco preferably of high nicotine content e.g. Nicotiana Rustica, or as a callus tobacco made by cell culture in a synthetic medium containing sugar. Generally the proportion of nicotine (calculated as free base) in the smoking materials will be at least 0.1%, and up to 5% by weight, depending upon the degree of fortification required.

Calcium and/or magnesium carbonates in the smoking materials may be in any desired physical form for example chalk, limestone, marble, calcite, magnesite, basic magnesium carbonate or dolomite. The proportion of calcium and/or magnesium carbonates in the smoking material may be for example from 5 to 80% by weight.

Water-soluble salts selected to inhibit dissolution of calcium and/or magnesium carbonate in water may be for example water-soluble salts of calcium and/or magnesium respectively. The anions of such water-soluble salts may be inorganic e.g. chloride or organic e.g. citrate. Calcium and magnesium sulphates are preferred. Alternatively or in addition other water-soluble salts may be used to inhibit the dissolution. Thus sodium and potassium sulphates inhibit the dissolution of calcium carbonate, though not of magnesium carbonate.

The phosphate buffer in the smoking materials may comprise an acid of one or more phosphoric acids of the generic formula $$xH_2O \cdot yP_2O_5$$

wherein $x/y$ has any value from 3 (orthophosphoric acid) to 1.

It has been found that smoking materials containing the disodium salt of pyrophosphoric acid ($x = 2, y = 1$ in the above generic formula) have good nicotine stability if cold conditions are used during fabrication and storage. When higher temperatures are used, however, smoking materials are preferred which contain acid salts of polyphosphoric acids wherein the ratio $x/y$ in the above formula is less than 2 and preferably from 1.5 to 1 since these have the best nicotine stability.

Neutral sodium salts of the higher polyphosphoric acids are commercially available as phosphate glasses. Thus for example "Calgon" (Registered Trade Mark) is the neutral sodium salt of a mixture of linear polyphosphoric acids of the above formula wherein the ratio $x/y$ is about 1.2, and "phosphate glass 696" is the neutral salt of such a mixture wherein the ratio $x/y$ is from about 1.07 to about 1.1. Phosphate glasses upon partial acidification with strong acids, e.g. sulphuric acid, give acid salts which are excellent buffers for incorporation in the smoking materials of the invention.

Phosphate buffers are effective in promoting nicotine stability even in such small proportions as 1 to 3% by weight. Desirably the proportion need not exceed 6%. Higher proportions are unnecessary and may result in unpleasant taste effects.

Although the invention is not restricted by any theory, it is believed that the improvement in nicotine stability which has been achieved is in consequence of an increase in the proportion of the nicotine which is held in protonated form. Acid salts of orthophosphoric acid alone are not effective in maintaining the nicotine in protonated form when in smoking materials containing calcium and/or magnesium carbonate. Probably during formulation of such smoking materials enough of the carbonate dissolves to exhaust the buffering action. However acid salts of the higher polyphosphoric acids i.e. those compounds of the above formula wherein the $x/y$ ratio is below 2 have better ability to maintain a suitably low pH, probably because they hydrolyse slowly to lower members of the series, thereby releasing protons. It is believed that this hydrolysis balances the rate of carbonate ion dissolution in water and is responsible for the low pH achieved. In the present smoking materials solution of the carbonate fillers during formulation or during storage under humid conditions is minimised by the presence of the water-soluble salts specified and the effect of the carbonates upon the buffer is thereby reduced, resulting in a further reduction in pH.

With the higher polyphosphoric acids very small amounts of water-soluble salts may suffice. Thus phosphate glasses (e.g. Calgon) when acidified with sulphuric acid sufficiently to produce an acid sodium salt also give rise to enough sodium sulphate for the mixture to be effective in stabilizing nicotine in smoking materials containing calcium carbonate, though the incorporation of additional sodium sulphate and/or calcium salt improves the effect.

Similarly when the higher polyphosphoric acids are included in smoking materials together with calcium and/or magnesium carbonate, some interaction takes place producing calcium and/or magnesium salts and a resultant pH of about 4 to 5.5. The salts so formed inhibit dissolution of the carbonates in water and also constitute a phosphate buffer. Nicotine is thereby stabilised. Incorporation of further solution-inhibiting salts improves the effect.

If desired the smoking materials may incorporate other components, for example humectants (e.g. glycerol), components giving rise to acidity in the smoke (e.g. lactic acid) whereby to reduce the chokiness produced by nicotine, flavourants, ash improvers etc.

Film forms of the smoking materials of the invention may conveniently be made by mixing all the ingredients in water to form a slurry or a pasty mass, spreading or extruding into a thin layer and drying.

Smoke produced by the smoking materials of the invention is very similar in chemical composition and in flavour to the smoke from comparable smoking materials containing no carbonate-solution-inhibiting salt or phosphate buffer. In particular the phosphates present in the smoking material do not appear to give rise to any harmful smoke constituent.

The invention is illustrated but not limited by the following Examples in which the parts and percentages are by weight.

Control Experiment A (without buffer or soluble salts)

14 parts of nicotine, 20 parts of lactic acid and 23.2 parts of glycerol were dissolved in 2300 parts of water. This solution was then used to make a slurry by stirring in 104 parts of a material made by heating $\alpha$-cellulose impregnated with 5% of its weight of ammonium sulphamate at 256° C. for 1.5 minutes (hereafter referred to as HTC), 19.2 parts of bentonite, 102.4 parts of magnesite, 59.2 parts of chalk and 58 parts of sodium carboxymethyl cellulose (hereinafter referred to as SCMC). When a homogeneous slurry had been formed its pH was measured using a combination glass electrode. The slurry was then cast on to a continuous stainless steel band and dried in an oven to from a film 0.006 inches thick.

This material was cut, shredded and a weighed sample was reslurried in water to the same solids content as in the original slurry. The pH of this reslurried material was also measured using a combination glass electrode. A further sample of the material was extracted with dilute sulphuric acid, and the extract was steam distilled under alkaline conditions and analysed for nicotine by UV spectroscopy. The remainder of the material was laid out on open trays and stored at 70° F., 66% RH under a flow of air of approximately ½-2 linear feet per second. Periodically a representative sample of the material was removed and its reslurried pH and nicotine content found. The results obtained are shown in table 1.

Control Experiment A.1 (with buffer, but no soluble salts)

Control Experiment A was repeated, except that 24 parts of potassium dihydrogen orthophosphate, 87.6 parts of magnesite and 50 parts of chalk were incorporated. Test results are shown in table 1.

EXAMPLE 1

Control Experiment A was repeated, except that 24 parts of potassium dihydrogen orthophosphate, 16 parts of magnesium sulphate heptahydrate, 77.6 parts of magnesite and 44 parts of chalk were incorporated. Test results are shown in Table 1.

Control Experiment B (with soluble salts but no buffer)

Control Experiment A was repeated, except that 16 parts of anhydrous magnesium sulphate, 8 parts of calcium sulphate, 87.2 parts of magnesite and 50.4 parts of chalk were incorporated. Test results are shown in table 2.

EXAMPLE 2

Control Experiment B was repeated, except that 6 parts of Calgon (dissolved in 100 parts of the water and the solution taken to pH 3.5 with sulphuric acid), 84 parts of magnesite and 48.8 parts of chalk were incorporated. Test results are shown in Table 2.

EXAMPLE 3

Control Experiment B was repeated, except that 12 parts of Calgon (solution taken to pH 3.5 with sulphuric acid), 79.6 parts magnesite and 46 parts chalk were incorporated. Test results are shown in Table 2.

EXAMPLE 4

Example 3 was repeated, except that the Calgon was replaced by Phosphate Glass 696, (solution taken to pH 3.5 with sulphuric acid). Test results are shown in Table 2.

EXAMPLE 5

Example 4 was repeated, except that the Calgon was replaced by Phosphate Glass 696 (solution taken to pH 3.5 with sulphuric acid). Test results are shown in Table 2.

Control Experiment C (with soluble salts but no buffer)

Control Experiment B was repeated, except that 8 parts of calcium sulphate and 8 parts of sodium sulphate were incorporated and the magnesite and chalk fillers were replaced by 145.6 parts of ground marble. Test results obtained are shown in table 3.

EXAMPLE 6

Control Experiment C was repeated except that 4 parts of "Calgon" (taken to pH 3.5 with sulphuric acid) and 141.6 parts of marble were incorporated. Test results are shown in Table 3.

EXAMPLE 7

Control Experiment C was repeated except that 12 parts of "Calgon" (taken to pH 3.5 with sulphuric acid) and 133.6 parts of marble were incorporated. Test results are shown in Table 3.

EXAMPLE 8

Control Experiment C was repeated except that 4 parts of Phosphate Glass 696 (taken to pH 3.5 with sulphuric acid) and 141.6 parts of marble were incorporated. Test results are shown in Table 3.

EXAMPLE 9

Control Experiment C was repeated except that 12 parts of Phosphate Glass 696 (taken to pH 3.5 with sulphuric acid) and 133.6 parts of marble were incorporated. Test results are shown in Table 3.

TABLE 1

| | Film Drying Results | | | Ageing Results | | | | | |
|---|---|---|---|---|---|---|---|---|---|
| | | | | Week 1 | | Week 3 | | Week 8 | |
| COMPOSITION | Slurry pH | pH of Re-slurried Film | % Nicotine Loss | pH of Reslurried Film | % Nicotine Loss | pH of Reslurried Film | % Nicotine Loss | pH of Reslurried Film | % Nicotine Loss |
| Control Experiment A | 7.2 | 7.2 | 9.1 | 6.9 | 11 | 6.8 | 26 | 6.7 | 31 |
| Control Experiment A.1 | 5.6 | 6.7 | 1.4 | 6.7 | 12 | 6.7 | 28 | 6.5 | 37 |
| Example 1 | 5.5 | 5.8 | 0 | 6.0 | 3 | 6.0 | 9 | 5.9 | 11 |

TABLE 2

| | Film Drying Results | | | Ageing Results | | | | | | | |
|---|---|---|---|---|---|---|---|---|---|---|---|
| | | | | Week 1 | | Week 2 | | Week 4 | | Week 8 | |
| Composition | Slurry pH | pH of Re-slurried Film | % Nicotine Loss | pH of Reslurried Film | % Nicotine Loss | pH of Reslurried Film | % Nicotine Loss | pH of Reslurried Film | % Nicotine Loss | pH of Reslurried Film | % Nicotine Loss |
| Comparative Experiment B | 6.9 | 7.1 | 7.7 | 6.8 | 5.3 | 6.7 | 19.2 | 6.8 | 26.0 | 6.8 | 31.9 |
| Example 2 | 5.4 | 5.4 | 1.7 | 5.2 | 2.0 | 5.3 | 5.2 | 5.3 | 7.8 | 5.3 | 13.7 |
| Example 3 | 4.8 | 5.1 | 0.6 | 5.0 | 4.6 | 5.0 | 7.2 | 5.1 | 9.2 | 5.1 | 18.1 |
| Example 4 | 5.2 | 5.4 | 0.3 | 5.3 | 4.9 | 5.3 | 4.7 | 5.3 | 3.7 | 5.3 | 14.6 |
| Example 5 | 4.9 | 5.0 | 0.3 | 5.0 | 0.6 | 4.9 | 2.6 | 5.0 | 4.9 | 4.9 | 17.2 |

TABLE 3

| | Film Drying Results | | | Ageing Results | | | | | | | |
|---|---|---|---|---|---|---|---|---|---|---|---|
| | | | | Week 1 | | Week 2 | | Week 4 | | Week 8 | |
| Composition | Slurry pH | pH slurried Film | % Nicotine Loss | pH of Reslurried Film | % Nicotine Loss | pH of Reslurried Film | % Nicotine Loss | pH of Reslurried Film | % Nicotine Loss | pH of Reslurried Film | % Nicotine Loss |
| CONTROL Experiment C | 7.0 | 7.5 | 9.6 | 7.2 | 17.9 | 7.3 | 25.3 | 7.2 | 41.8 | 7.0 | 52.1 |
| Example 6 | 5.3 | 5.1 | 3.6 | 5.0 | 4.9 | 5.1 | 2.9 | 5.0 | 11.7 | 4.9 | 22.1 |
| Example 7 | 5.0 | 5.0 | 3.6 | 4.9 | 2.9 | 4.9 | 0 | 4.9 | 4.9 | 4.9 | 8.4 |
| Example 8 | 5.2 | 5.2 | 3.8 | 5.1 | 0 | 5.0 | 0 | 5.1 | 4.2 | 5.0 | 22.5 |
| Example 9 | 5.1 | 5.3 | 0.3 | 5.1 | 5.3 | 5.0 | 3.3 | 5.1 | 10.6 | 5.0 | 27.9 |

EXAMPLE 10

This illustrates a typical smoking material of the invention and an investigation of its smoke chemistry and nicotine delivery and includes a flavour assessment of the smoking material when blended with tobacco.

The following ingredients were made into films in the manner described in previous Examples.

| | Example 10 parts | Control D parts |
|---|---|---|
| HTC | 26 | 26 |
| SCMC | 14.5 | 14.5 |
| Glycerol | 5.8 | 5.8 |
| Calcite | 44.2 | 39.2 |
| Ammonium sulphate | 0 | 2 |
| Bentonite | 0 | 4 |
| Nicotine | 3.5 | 3.5 |
| Lactic acid | 0 | 5 |
| Calgon (acidified in solution to pH 3.2 with sulphuric acid) | 2 | 0 |
| Sodium sulphate | 2 | 0 |
| Calcium sulphate | 2 | 0 |

Material from each composition was shreadded and made into standard 1.1 g cigarettes which were machine smoked under standard conditions of one 35 ml, 2 second druation puff every minute and the smoke was analysed for the smoke species listed in the following table.

| Smoke Species | | Example 10 | Control D |
|---|---|---|---|
| Total particulate matter (wet) | mg/cig | 16.5 | 15.0 |
| Nicotine | mg/cig | 2.8 | 2.35 |
| Particulate matter (water and nicotine free) | mg/cig | 12.2 | 12.4 |
| $H_2S$ | μg/cig | 8.3 | 14.1 |
| HCN | " | 53 | 39 |
| Total phenols | " | 56 | 52 |
| Formaldehyde | " | 125 | 83 |
| Ammonia | " | 18 | 21 |
| Total volatiles (ug as MEK in 3rd puff) | | 655 | 876 |
| $CO_2$ | mg/cig | 55 | 55 |
| CO | " | 8.0 | 8.3 |
| Total aldehydes | μg/cig | 634 | 657 |
| Acetaldehyde (ug as MEK in 3rd puff) | | 68 | 113 |
| Acrolein | | 210 | 163 |
| Benzo α-pyrene | ng/cig | 19.8 | 30.3 |

It may be seen that the test composition gave broadly similar yields of smoke species to those from the control.

The extent of transfer of phosphorus compounds to smoke was investigated because of the toxicity of some phosphorus compounds. The particulate and vapour phase components of smoke from approximately 550 cigarettes containing the material of Example 10 were collected by impaction trap and by trapping in methanol at −78° C. respectively. Cigarettes containing the material of Control Example D were treated similarly. Samples of the tar and methanol solutions were combusted in an oxygen bomb with sodium peroxide and the products analysed for phosphoric acid by the precipitation of quinoline phosphomolybdate (Ref. H.N.Wilson, Analyst 76, 65–76 (1951). A.F. Colson, Analyst, 71, 322–326 (1946). The method was modified slightly to reduce the detection limit to 10 ppm for tar samples and to 15 ppm for the volatiles solution.

The results obtained were as follows:

| | PHOSPHORUS DELIVERY PER CIGARETTE | |
|---|---|---|
| | In Tar Phase | In Volatile Phase |
| Control D | None detected (detection limit 0.1 μg) | None detected (Detection limit 0.8 μg) |
| Example 10 | None detected (detection limit 0.06 μg) | None detected (detection limit 1.0 μg) |

These results show that, if any phosphorus is transferred to mainstream smoke, then the level of transfer is very low.

Material from these compositions was also stored in bulk for 2 months, then made into cigarettes which were subjected to ageing in open trays for 10 weeks in a large, air-conditioned room (66% RH, 70° F.). They were then reanalysed for nicotine delivery. The results are shown in the following table.

| | Ex. 10 | Control D |
|---|---|---|
| Initial Nicotine delivery (mg/cig) | 2.80 | 2.35 |
| Nicotine delivery after 10 weeks storage (mg/cig) | 1.71 | 0.95 |

The stability of the nicotine in the composition may be seen to be much improved even uner the rigorous testing conditions used.

Further quantities of the smoking material of Example 10 and of Control D were each blended with an equal weight of tobacco and the blends made up into standard cigarettes. These were test smoked comparatively by a panel of expert smokers specially selected for their long experience and sensitivity to variations in smoke flavour. The panel found that both test and control cigarettes were similar in overall flavour.

EXAMPLE 11

This illustrates a smoking material of the invention wherein the major portion of the fuel (SCMC) is also a binder.

The following ingredients were made into films in the manner described in previous Examples.

| | Control E % | Ex. 11.1 % | Ex. 11.2 % |
|---|---|---|---|
| SCMC | 27.5 | 27.5 | 27.5 |
| Glycerol | 7.7 | 7.7 | 7.7 |
| Perlite | 25.9 | 24.9 | 23.0 |
| Calcium carbonate (limestone) | 28.0 | 27.0 | 24.9 |
| Urea | 1.8 | 1.8 | 1.8 |
| Carbon | 0.6 | 0.6 | 0.6 |
| Nicotine | 3.5 | 3.5 | 3.5 |
| Lactic acid | 5 | 5 | 5 |
| Calgon (acidified in solution to pH 3.2 with sulphuric acid) | 0 | 2 | 2 |
| Calcium sulphate | 0 | 0 | 2 |
| Sodium sulphate | 0 | 0 | 2 |

The materials were cut and exposed to open tray ageing. Test results are shown in the following table.

| | Film Drying Results | | | |
|---|---|---|---|---|
| Composition | Slurry pH | pH of reslurried film | % Nicotine loss | % Nicotine loss during 2 weeks drying |
| Control E | 7.6 | 8.0 | 22.0 | 99.2 |
| Example 11.1 | 6.4 | 5.9 | 18.0 | 25.6 |
| Example 11.2 | 5.8 | 5.5 | 9.4 | 24.2 |

The results show that the use of acidified Calgon alone causes a very great improvement in stability on ageing, with hardly any improvement caused by use of further sodium and calcium sulphates. However the additional sulphates do cause further reduction in nicotine loss during film drying.

EXAMPLE 12

In this example ball-milled Rustica tobacco is employed both as the particulate fuel, and as the source of nicotine.

The following ingredients were made into films in the manner described in previous Examples.

| | Control F parts | Ex. 12.1 parts | Ex. 12.2 parts |
|---|---|---|---|
| Ball-milled Rustica tobacco | 26 | 26 | 26 |
| SCMC | 14.5 | 14.5 | 14.5 |
| Glycerol | 5.8 | 5.8 | 5.8 |
| Calcite | 48.9 | 46.9 | 42.9 |
| Bentonite | 4.8 | 4.8 | 4.8 |
| Calgon (acidified in solution to pH 3.5 with sulphuric acid) | 0 | 2 | 2 |
| Sodium sulphate | 0 | 0 | 2 |
| Calcium sulphate | 0 | 0 | 2 |

The films prepared were subjected to open-tray ageing. The results are shown in the following table.

| Composition | pH of reslurried film | Nicotine loss during film drying | Nicotine loss during ageing |
|---|---|---|---|
| Control F | 6.93 | 4.2 | 16 (4 weeks) |
| Example 12.1 | 5.87 | 1.4 | 18 (8 weeks) |
| Example 12.2 | 5.67 | 0 | 0 (8 weeks) |

Though acidified Calgon alone gives improved nicotine stability, the further addition of the soluble salts enhances the effect.

EXAMPLE 13

In this example ball-milled flue-cured tobacco was used as particulate fuel, and further nicotine was added in the form of an ethanol extract of Rustica tobacco. Calcium chloride was used as the soluble salt.

The following ingredients were made into films in the manner described in previous Examples.

| | Control G parts | Ex. 13.1 parts | Ex. 13.2 parts |
|---|---|---|---|
| Ball-milled flue-cured tobacco | 26.0 | 26.0 | 26.0 |
| SCMC | 4.5 | 4.5 | 4.5 |
| Glycerol | 5.8 | 5.8 | 5.8 |
| Calcite | 36.8 | 34.8 | 32.8 |
| Ether extract of Rustica tobacco | 15.1 | 15.1 | 15.1 |
| Bentonite | 4.8 | 4.8 | 4.8 |
| Calgon (acidified in solution to pH 3.5 with sulphuric acid) | 0 | 2 | 2 |
| Calcium chloride | 0 | 0 | 2 |

The results of open-tray ageing trials on these materials are given in the following table.

| Composition | Reslurry pH | % Nicotine loss on film drying | % Nicotine loss drying 8 weeks ageing |
|---|---|---|---|
| Control G | 6.43 | 0 | 34 |
| Example 13.1 | 5.60 | 0 | 19 |
| Example 13.2 | 5.20 | 0 | 12 |

The improved nicotine stability produced by acidified Calgon is enhanced by use of additional soluble salt.

EXAMPLE 14

In this example the effectiveness of magnesium chloride and calcium citrate as carbonate solution inhibitors with acidified Calgon is shown in a smoking material containing both magnesium and calcium carbonates.

The following ingredients were made into films in the manner described in previous Examples.

| | Control H parts | Ex. 14.1 parts | Ex. 14.2 parts |
|---|---|---|---|
| HTC | 26.0 | 26.0 | 26.0 |
| SCMC | 14.5 | 14.5 | 14.5 |
| Glycerol | 5.8 | 5.8 | 5.8 |
| Calcite | 16.8 | 16.1 | 14.5 |
| Magnesite | 28.6 | 27.3 | 24.7 |
| Bentonite | 4.8 | 4.8 | 4.8 |
| Nicotine | 3.5 | 3.5 | 3.5 |
| Calgon (acidified to pH 3.5 with sulphuric acid) | 0 | 2 | 2 |
| Magnesium chloride | 0 | 0 | 1.6 |
| Calcium citrate | 0 | 0 | 2.6 |

pH values of the slurries and of the re-slurried film are shown in the following table.

| Composition | Control | Example 14.1 | Example 14.2 |
|---|---|---|---|
| Slurry pH | 7.5 | 7.1 | 6.0 |
| pH of relurried film | 7.7 | 6.7 | 5.6 |

The effectiveness of the calcium citrate and magnesium chloride as carbonate solution inhibitors, allowing the Calgon to maintain a lower pH may be seen.

EXAMPLE 15

In this example the effectiveness of magnesium citrate as a carbonate-soltuion inhibitor is shown in a smoking material containing magnesium carbonate.

The following ingredients were made into films in the manner described in previous Examples.

| | Control I parts | Example 15.1 parts | Example 15.2 parts |
|---|---|---|---|
| HTC | 26 | 26 | 26 |
| SCMC | 14.5 | 14.5 | 14.5 |
| Glycerol | 5.8 | 5.8 | 5.8 |
| Magnesite | 46.9 | 44.9 | 42.3 |
| Bentonite | 4.8 | 4.8 | 4.8 |
| Nicotine | 2.0 | 2.0 | 2.0 |
| Phosphate Glass 696 (acidified to pH 3.5 with sulphuric acid) | 2 | 2 | 2 |
| Magnesium citrate | 0 | 0 | 2.6 |

pH values of the slurries and of the re-slurried film are shown in the following table.

| Composition | Control I | Example 15.1 | Example 15.2 |
|---|---|---|---|
| pH of slurry | 7.47 | 5.45 | 5.25 |
| pH of reslurried film | 7.53 | 5.95 | 5.43 |

The effect of magnesium citrate as a carbonate-solution inhibitor, allowing the Calgon to maintain a lower pH may be seen.

The next two examples demonstrate the effect produced by the use of a polyphosphoric aicd as a source of both buffer and carbonate solution-inhibiting salt.

EXAMPLE 16

The following ingredients were made into films in the manner described in previous Examples.

| | Control J parts | Example 16.1 parts | Example 16.2 parts |
|---|---|---|---|
| HTC | 26 | 26 | 26 |
| SCMC | 15 | 15 | 15 |
| Glycerol | 6 | 6 | 6 |
| Bentonite | 5 | 5 | 5 |
| Marble | 46 | 44 | 40 |
| Tetraphosphoric acid | 0 | 2 | 2 |
| Nicotine | 2 | 2 | 2 |
| $Na_2SO_4$ | 0 | 0 | 2 |
| $CaSO_4$ | 0 | 0 | 2 |

Gas evolution was observed when the marble came into contact with the solution of acid. pH values of the slurries and of the re-slurried films are shown in the following table:

| Composition | Control J | Example 16.1 | Example 16.2 |
|---|---|---|---|
| pH of slurry | 6.8 | 5.1 | 4.6 |
| pH of reslurried film | 7.7 | 5.3 | 5.0 |

The effect of the polyphosphoric acid alone in maintaining a low pH may be seen, though the effect is enhanced by the use of further salts to inhibit carbonate dissolution.

EXAMPLE 17

The following ingredients were made up into films in the manner described in previous Examples.

| | Control J parts | Example 17.1 parts | Example 17.2 parts |
|---|---|---|---|
| HTC | 26 | 26 | 26 |
| SCMC | 15 | 15 | 15 |
| Glycerol | 6 | 6 | 6 |
| Bentonite | 5 | 5 | 5 |
| Magnesite | 46 | 44 | 42 |
| Polyphosphoric acid | 0 | 2 | 2 |
| $MgSO_4$ | 0 | 0 | 2 |
| Nicotine | 2 | 2 | 2 |

Gas evolution was observed when the magnesite came into contact with the solution containing the polyphosphoric acid. pH values of the slurries and of the re-slurried films are shown in the following table:

| | Control J | Example 17.1 | Example 17.2 |
|---|---|---|---|
| Initial slurry pH | 6.4 | 4.3 | 4.1 |
| Reslurry pH | 7.5 | 5.4 | 5.1 |

The strong effect produced by the polyphosphoric acid alone is maintaining a low pH is enhanced by the use of additional salt to inhibit carbonate dissolution.

EXAMPLE 18

This example demonstrates the effectiveness of a salt of trisodium metaphosphate, a polymeric phosphate with a high proportion of $P_2O_5$ (mole ratio of $H_2O/P_2O_5 = 1.0$).

The following ingredients were made up into films in the manner described in previous Examples.

| | Control K parts | Example 18 parts |
|---|---|---|
| HTC | 26 | 26 |
| SCMC | 14.5 | 14.5 |
| Glycerol | 5.8 | 5.8 |
| Marble | 43.4 | 41.4 |
| Bentonite | 4.8 | 4.8 |
| Sodium trimetaphosphate (solution acidified to pH 3.3 before addition) | 0 | 2.0 |
| Nicotine | 3.5 | 3.5 |
| Calcium chloride | 2.0 | 2.0 |

pH values and nicotine losses are shown in the following table.

| | Control K | Example 18 |
|---|---|---|
| pH of slurry | 6.6 | 5.9 |
| pH of reslurried film | 7.0 | 5.7 |
| % Nicotine loss during film drying | 8.3 | 2.3 |

We claim:

1. A smoking material comprising smoke-producing fuel, fortifying nicotine, calcium and/or magnesium carbonate as incombustible filler, at least one water-soluble salt selected from water-soluble calcium and magnesium salts, and sodium and potassium sulphate in the case where the incombustible filler is calcium carbonate, and a phsophate buffer consisting of an acid salt of orthophosphoric acid or of a polyphosphoric acid, the amount of such phosphate buffer being sufficient to improve the nicotine stability and such that when the smoking material is slurried with water to give a 15% solution/suspension the aqueous solution has a pH between 6 and 4.

2. A smoking material according to claim 1 wherein the smoke-producing fuel comprises a thermally degraded carbohydrate.

3. A smoking material according to claim 1 wherein at least a portion of the smoke-producing fuel is such that it also functions as a binder.

4. A smoking material according to claim 3 wherein at least a portion of the smoke-producing fuel is sodium carboxymethyl cellulose.

5. A smoking material according to claim 1 wherein fortifying nicotine is in the form of a salt with an organic acid.

6. A smoking material according to claim 1 wherein fortifying nicotine is in the form of a tobacco extract.

7. A smoking material according to claim 1 wherein the fortifying nicotine is in the form of a tobacco of high nicotine content.

8. A smoking material according to claim 1 wherein fortifying nicotine is in the form of a callus tobacco.

9. A smoking material according to claim 1 wherein the water-soluble salt is a calcium or magnesium salt.

10. A smoking material according to claim 9 wherein the water-soluble salt is calcium or magnesium sulphate.

11. A smoking material according to claim 1 comprising calcium carbonate and sodium or potassium sulphate.

12. A smoking material according to claim 1 wherein the phosphate buffer comprises an acid salt of one or more phosphoric acids of the generic formula $$xH_2O \cdot yP_2O_5$$

wherein $x/y$ has any value from 3 to 1.

13. A smoking material according to claim 12 wherein $x$ in the formula is an integer from 3 to 30.

14. A smoking material according to claim 12 wherein $x$ in the formula is an integer from 5 to 30.

15. A smoking material according to claim 1 wherein the phosphate buffer comprises an acid salt of one or more cyclic polyphosphoric acids of the generic formula $(HPO_3)_y$ wherein $y$ is an integer from 3 to 30.

16. A smoking material according to claim 1 wherein the phosphate buffer is present in a proportion of 1 to 6%.

17. A smoking material according to claim 16 wherein the phosphate buffer is present in a proportion of 1 to 3%.

* * * * *